US009545357B2

(12) United States Patent
Pathrose

(10) Patent No.: US 9,545,357 B2
(45) Date of Patent: Jan. 17, 2017

(54) MASSAGING APPARATUS

(71) Applicant: John Pathrose, Calgary (CA)

(72) Inventor: John Pathrose, Calgary (CA)

( * ) Notice: Subject to any disclaimer, the term of this patent is extended or adjusted under 35 U.S.C. 154(b) by 587 days.

(21) Appl. No.: 14/052,776

(22) Filed: Oct. 14, 2013

(65) Prior Publication Data

US 2014/0107545 A1 Apr. 17, 2014

Related U.S. Application Data

(60) Provisional application No. 61/713,453, filed on Oct. 12, 2012.

(51) Int. Cl.
*A61H 15/00* (2006.01)

(52) U.S. Cl.
CPC ... *A61H 15/0092* (2013.01); *A61H 2015/0064* (2013.01); *A61H 2201/1253* (2013.01); *A61H 2201/1284* (2013.01); *A61H 2201/1454* (2013.01); *A61H 2201/164* (2013.01); *A61H 2201/1623* (2013.01); *A61H 2201/1635* (2013.01); *A61H 2205/06* (2013.01); *A61H 2205/081* (2013.01); *A61H 2205/10* (2013.01)

(58) Field of Classification Search
CPC ..... A61H 15/0092; A61H 2015/0064; A61H 2201/164; A61H 2201/1635; A61H 2201/1623; A61H 2201/1253; A61H 2205/10; A61H 2201/1284; A61H 2205/081; A61H 2205/06; A61H 2201/1454
See application file for complete search history.

(56) References Cited

U.S. PATENT DOCUMENTS

| | | | | |
|---|---|---|---|---|
| 1,947,042 | A | 2/1934 | Glennan | |
| 2,797,685 | A | 7/1957 | Packwood | |
| 4,116,233 | A * | 9/1978 | Scaduto | A61H 15/0092 601/113 |
| 5,868,689 | A | 2/1999 | Faroky et al. | |
| 6,093,159 | A * | 7/2000 | Racoosin | A61H 15/0092 601/118 |
| 7,481,783 | B1 | 1/2009 | Kelley | |
| 2005/0209072 | A1 * | 9/2005 | Sheron | A63B 21/0618 482/132 |
| 2014/0336550 | A1 * | 11/2014 | Zedaker | A61H 7/007 601/131 |

* cited by examiner

*Primary Examiner* — Quang D Thanh
(74) *Attorney, Agent, or Firm* — Loza & Loza, LLP; Razmig H. Messerian

(57) ABSTRACT

The present invention relates to a massaging apparatus. The massaging apparatus is comprised of a massage sphere that can be rotated with the use of adjacent ball bearings. The massage sphere is encased in an upper, midsection and lower housings, whereby only a section of the massage sphere is exposed. A strap is connected to the lower housing, and can be wrapped around the midsection housing for easy storage. To use the massaging apparatus, one simply has to hold the device and roll the exposed part of the massage sphere over the desired area. In order to massage hard to reach areas such as the back, both ends of the strap are held in each hand, and the massaging apparatus is placed on a hard surface such as a wall, in between the wall and the person's back. The user holds the straps and applies pressure onto the massaging apparatus.

13 Claims, 12 Drawing Sheets

MASSAGING APPARATUS

CLAIM OF PRIORITY

The present application for patent claims priority to U.S. Provisional Application No. 61/713,453 entitled "Massaging Apparatus" filed Oct. 12, 2012, the entire disclosure of which is hereby expressly incorporated by reference herein.

BACKGROUND

Field

The present invention relates to the field of massage devices, and more specifically to ball bearing massage devices.

Background

Massage therapy, yoga and spas in general have become increasingly popular, especially given recent studies that have indicated that such activities are therapeutic, help relieve stress and relax the body. In a similar vein, personal massage devices have also been devised in order to help relieve said stress and relax joints and muscles.

Many devices have purported to engage in massaging the body, by rubbing the device on the aching muscles, activating something on said device to contact the muscles. Devices such as U.S. Pat. No. 1,947,042 (Glennan), U.S. Pat. No. 2,797,685 (Packwood), U.S. Pat. No. 5,868,689 (Faroky et al.) and U.S. Pat. No. 7,481,783 (Kelley) have been designed as handheld massaging apparatuses with an attachment such as a massaging sphere that rolls around to soothe muscles.

Glennan, Packwood and Kelly each disclose a similar handheld device with a massaging ball or sphere which rotates around smaller ball bearings. Over half the diameter of the sphere is encased in a portion of the respective devices such that the sphere can rotate freely without ever rolling out of the device. These devices are each comprised of a handheld portion such that one can take the apparatus, and roll the ball over muscles in the arm, leg, etc. and exert as much pressure as is desired to relax the muscles and joints. Kelly's device specifically discloses variants that include multiple balls, located within certain distances one from the other such that an increased area is massaged at the same time. Unfortunately, these devices are not designed to massage hard to reach areas such as the upper and lower back.

The Faroky et al. patent describes a hand held massaging device comprising a first and second handle that are interconnected to a rubber ball. The handles are interconnected to the rubber ball through the use of a cord which travels through the rubber ball, which is used as a massage ball. Although this device allows for a certain level of adjustability for the user to maximize its massaging effect, the use of the cord requires a complex assembly which is not ideal for manufacturing or for eventual use by a person.

There is therefore a need for an improved massaging device that can be easily used and operated without the need for a complex internal assembly of the massaging device. There is also a need for a massaging device that has two straps that can easily wrap around the device, and can separate one from the other and be held by each hand in order to suspend the device, place it against a wall and massage hard to reach areas such as one's back. Finally, there is a need for a device that does not have to be held in one's hand, such that it can be placed somewhere (for instance, against a wall) and held in place by both a protective or friction pad and by the pressure exerted upon it by one's hand, back, leg, etc. Indeed, the devices above need to remain stationary by means of human assistance, rather than by the use of a friction enhancing member such as is facilitated by the present device.

SUMMARY

The present invention provides a massaging apparatus comprising a massage sphere for applying massaging pressure, an upper housing having an opening for receiving the massage sphere, a midsection housing operatively connected to the upper housing surrounding the massage sphere, a lower housing operatively connected to the midsection housing and enclosing the massage sphere, fastening means to connect for connecting the lower housing to the upper housing, and a strap secured to the midsection housing for movement of the massaging apparatus, wherein the massage sphere is rotatably secured enclosed within the upper, midsection and lower housings.

BRIEF DESCRIPTION OF THE DRAWINGS

It will now be convenient to describe the invention with particular reference to one embodiment of the present invention. It will be appreciated that the drawings relate to one embodiment of the present invention only and are not to be taken as limiting the invention.

DETAILED DESCRIPTION

The present invention will now be described more fully hereinafter with reference to the accompanying drawings, in which preferred and other embodiments of the invention are shown. No embodiment described below limits any claimed invention and any claimed invention may cover processes or apparatuses that are not described below. The claimed inventions are not limited to apparatuses or processes having all the features of any one apparatus or process described below or to features common to multiple or all of the apparatuses described below. It is possible that an apparatus or process described below is not an embodiment of any claimed invention. The applicants, inventors or owners reserve all rights that they may have in any invention claimed in this document, for example, the right to claim such an invention in a continuing application and do not intend to abandon, disclaim or dedicate to the public any such invention by its disclosure in this document.

The terms "coupled" and "connected", along with their derivatives, may be used herein. It should be understood that these terms are not intended as synonyms for each other. Rather, in particular embodiments, "connected" may be used to indicate that two or more elements are in direct physical or electrical contact with each other. "Coupled" may be used to indicated that two or more elements are in either direct or indirect (with other intervening elements between them) physical or electrical contact with each other, or that the two or more elements co-operate or interact with each other (e.g. as in a cause and effect relationship).

Figure 1:
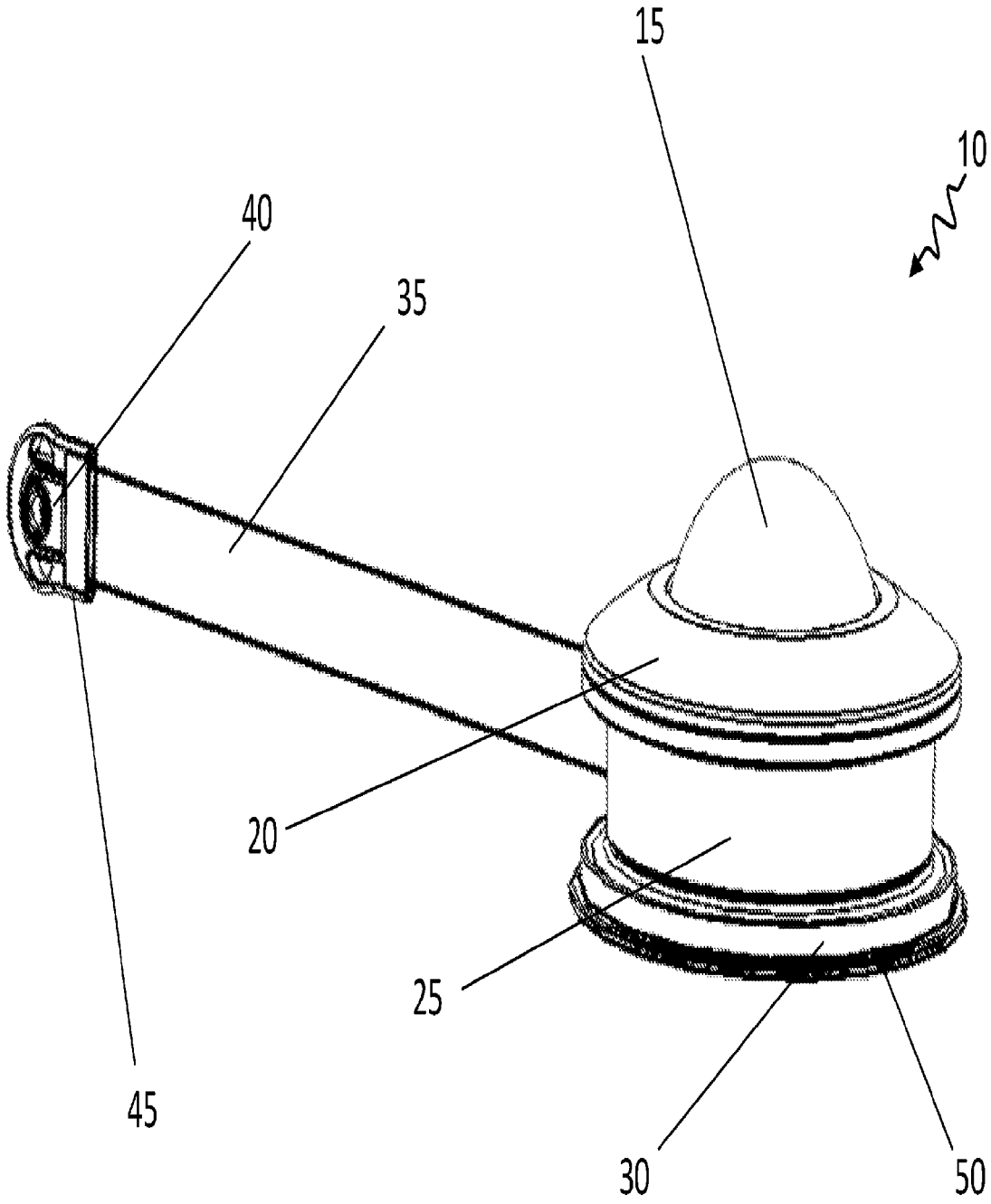
FIG. 1 is a perspective view of a massaging apparatus, according to one embodiment of the present invention.

With reference to FIG. 1, a massaging apparatus 10 is shown. The massaging apparatus 10 is primarily comprised of a massage sphere 15 for applying a messaging pressure, encased in an upper housing 20, midsection housing 25 and lower housing 30. The upper housing 20 is fastened to the lower housing 30 by fastening means such as screws (not shown) fastened through the underside (not shown) of the lower housing 30, while the midsection housing 25 is connected to the both the upper and lower housings 20, 30. The relationship between the upper, midsection and lower housings 20, 25, 30 is further detailed below. A strap 35 is connected to a T-bar (not shown) through an aperture (not shown) of the midsection housing 25. Male and female clasps 40, 45 are connected at opposite ends of the strap 35 and serve to clasp onto one another depending on the use of the massaging apparatus 10. The functioning of the male and female clasps 40, 45 is further explained below; however, a worker skilled in the relevant art would appreciate that male and female clasps 40, 45 could not be present in massaging apparatus 10 as disclosed herein. Indeed, a worker skilled in the art could appreciate a simple strap with no clasps such that the shape of the strap itself would suffice in order to be secured within the midsection housing 25 of the massaging apparatus 10. The strap, being in the general shape of a rectangle, would be able to use its outer edges in order to wrap around the midsection housing 25 of the massaging apparatus 10 and be releasably secured therein. In order to use the massaging apparatus 10, the massaging apparatus 10 can be fixed to a position on a wall, table, or other place. A protective rim 50 is operatively connected to the underside (not shown) of the lower housing 30 in order to protect any of said surfaces from damage such as scratches. A worker skilled in the relevant art would appreciate that the protective rim 50 could be a friction pad, suction cups, or other similar means of cushioning the device while providing some amount of friction against a wall, without departing from the spirit and scope of the present device.

Figure 2:
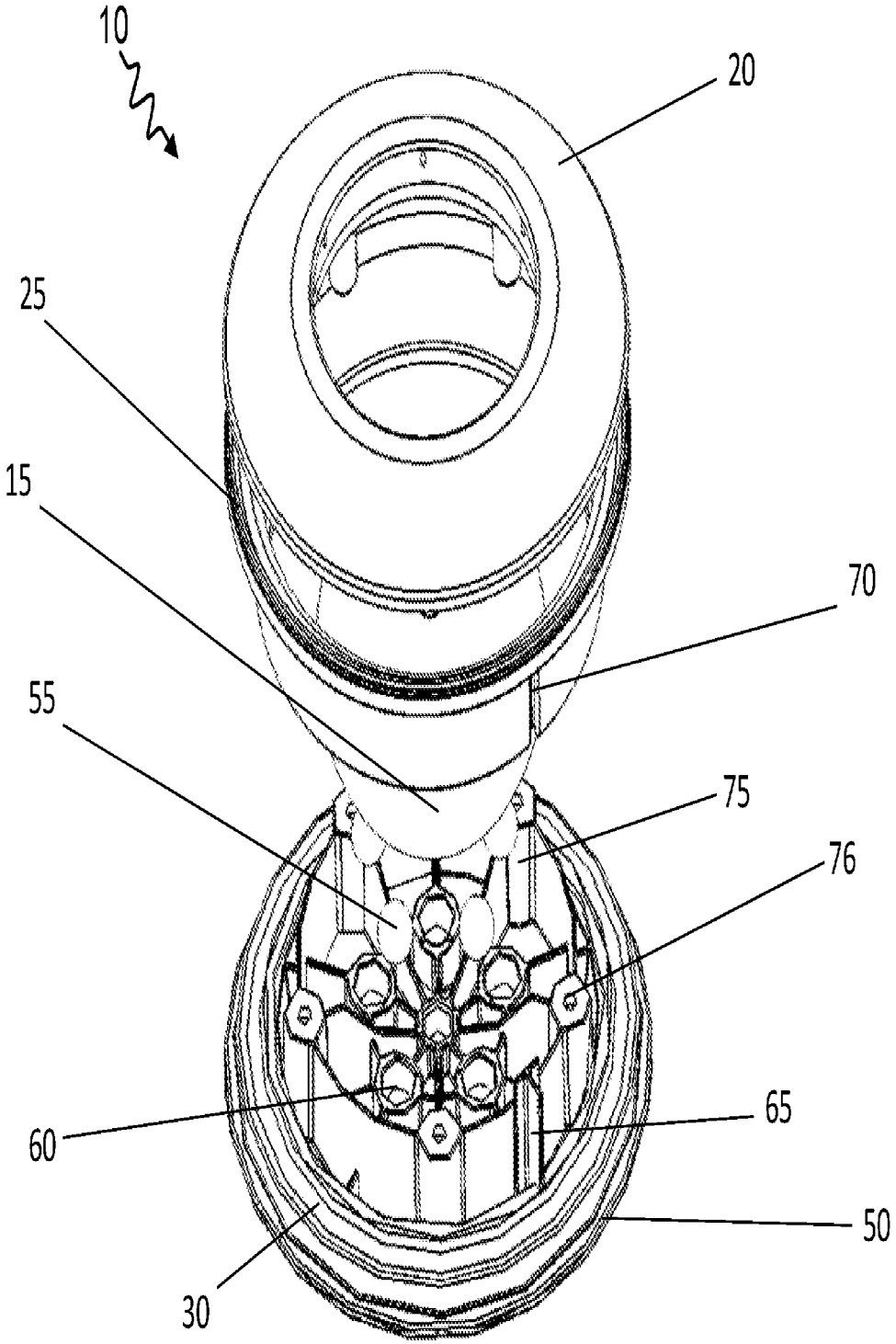
FIG. 2 is an exploded view of a massaging apparatus without a strap, according to one embodiment of the present invention.
Figure 3:
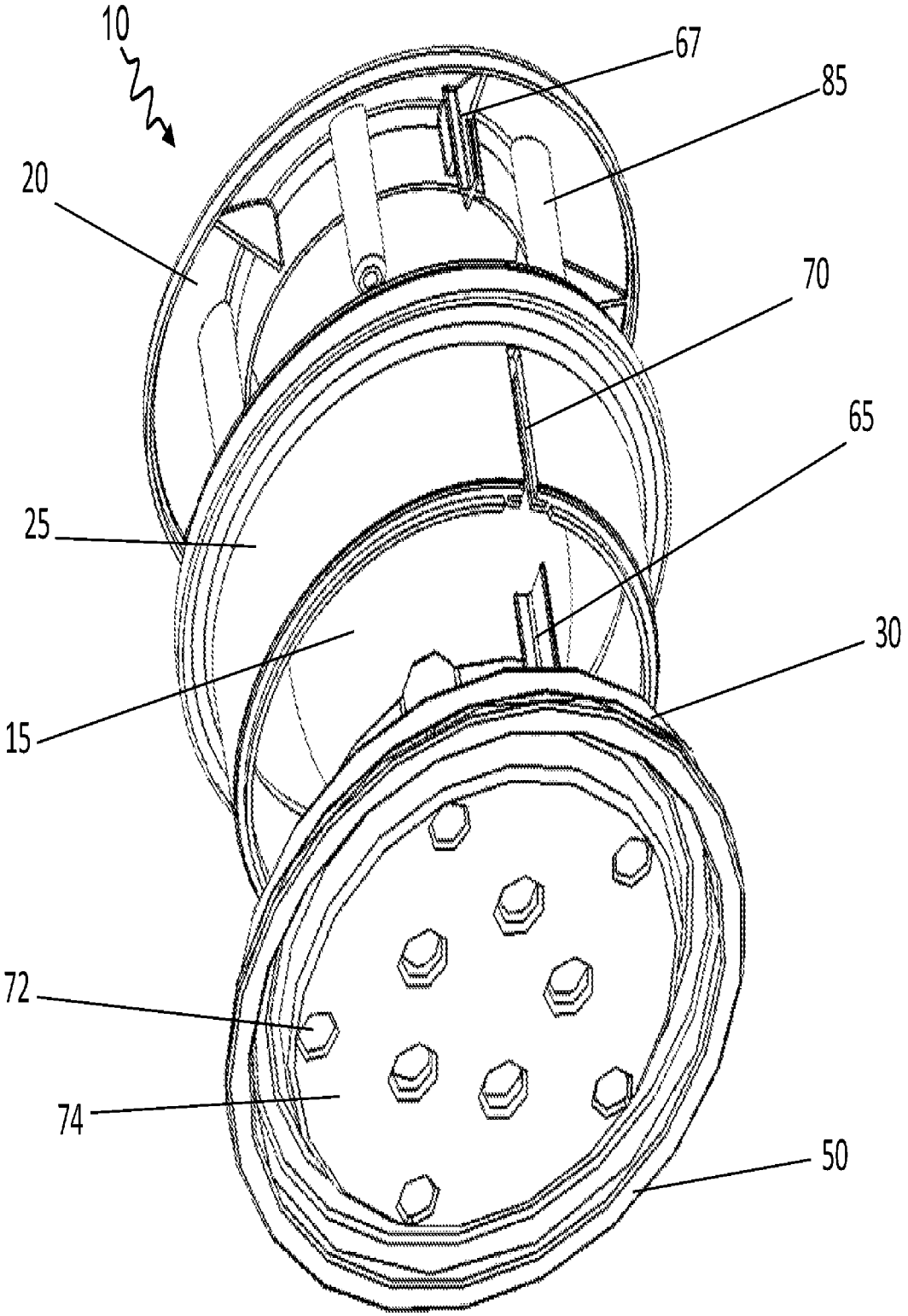
FIG. 3 is a second exploded view of a massaging apparatus without a strap, according to one embodiment of the present invention.

With reference to FIGS. 2 and 3, the various parts of the massaging apparatus 10 are shown separated one from the other for illustrative purposes. Ball bearings 55 are shown, normally located within cavities 60 and make contact with massage sphere 15 such that when the massage sphere 15 rotates, the ball bearings 55 rotate around themselves with very little friction until the movement of the massage sphere 15 ceases. T-bar 65 can also be seen in greater detail and serves to latch onto the strap (not shown) through an aperture 70 such that said strap (not shown) is secured at all times to the massaging apparatus 10.

With further reference to FIGS. 2 and 3, a securing member 67 is also shown in greater detail, protruding from the upper housing 20. When the upper, midsection and lower housings 20, 25, 30 are connected to one another, T-bar 65 and securing member 67 almost connect one to the other, such that their quasi-connection prevents the strap (not shown) from being removed from the aperture 70 of the massaging apparatus 10. Five outer chambers 72 are also shown in greater detail on the underside 74 of the lower housing 30. Fastening means such as screws (not shown) are fitted in said outer chambers 72 and are positioned into slots 76 of protrusions 75 to ultimately connect to recesses 85 on the upper housing 20. The protective rim 50 is also shown in greater detail and is wider and thicker than the outer extremities of the underside 74 of the lower housing 30 such that the protective rim 50 makes contact with whatever surface the massaging apparatus 10 is placed upon. A worker skilled in the relevant art would appreciate that the protective rim 50 could be made of various types of materials, such as soft fabrics, malleable plastics, etc. without departing from the spirit and scope of the present device.

Figure 4:
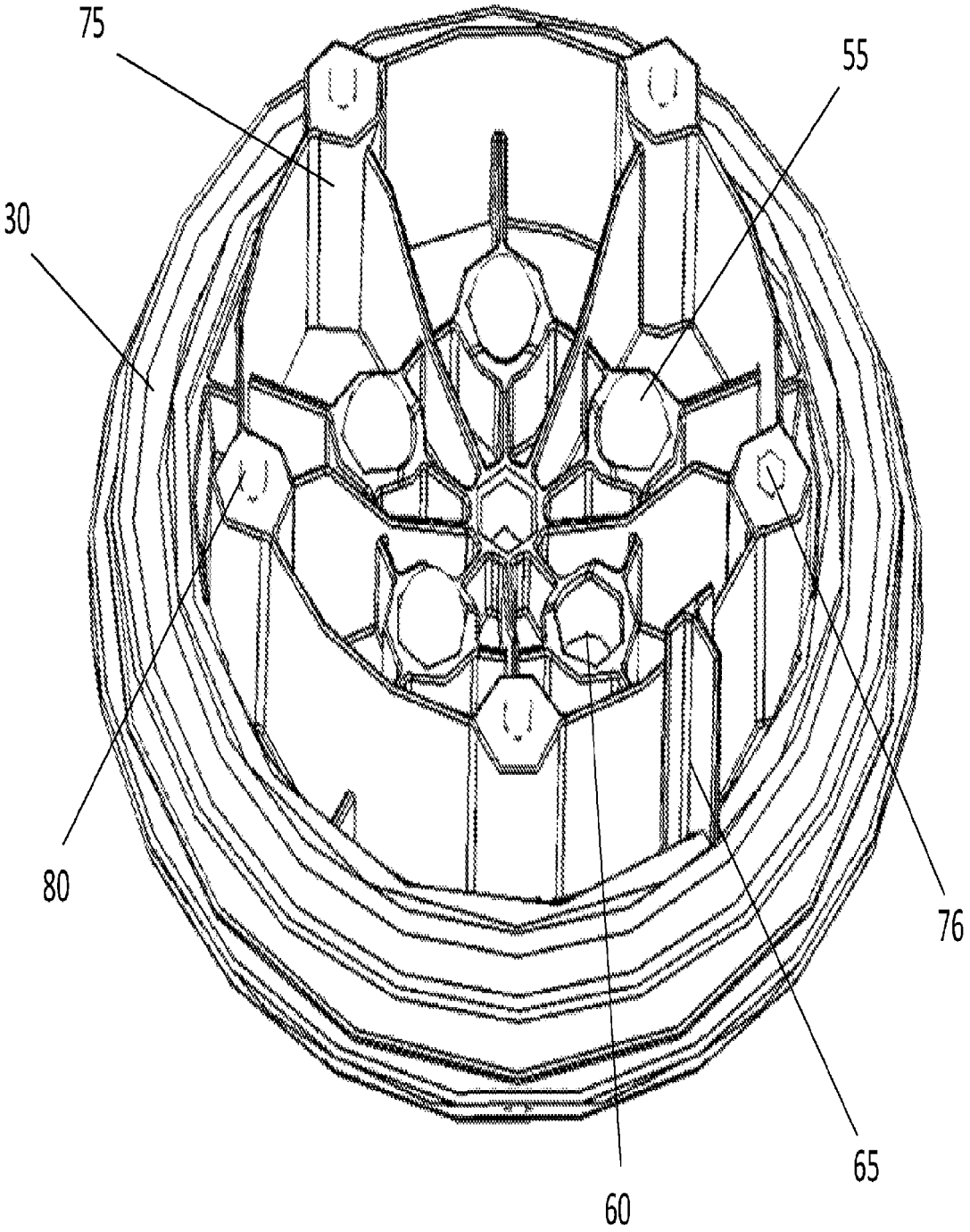
FIG. 4 is an perspective view of a lower housing and ball bearings as installed in a massaging apparatus, according to one embodiment of the present invention.

With reference to FIG. 4, four of the ball bearings 55 are shown within their respective cavities 60 within the lower housing 30. Five protrusions 75 are also shown and four screws 80 can be seen extending out of slots 76 of said protrusions 75 to connect to recesses (not shown) of the upper housing (not shown). The fastening by the screws 80 of the protrusions 75 and the recesses (not shown) encases the massage sphere (not shown) and prevents upper, midsection and lower housings 20, 25 30 from getting displaced with respect to each other. The T-bar 65, to which is attached the strap (not shown) is also shown with greater clarity. The midsection housing 25 being operatively connected to the upper housing 20 and the lower housing 30 is also operatively connected to midsection housing 30.

Figure 5:
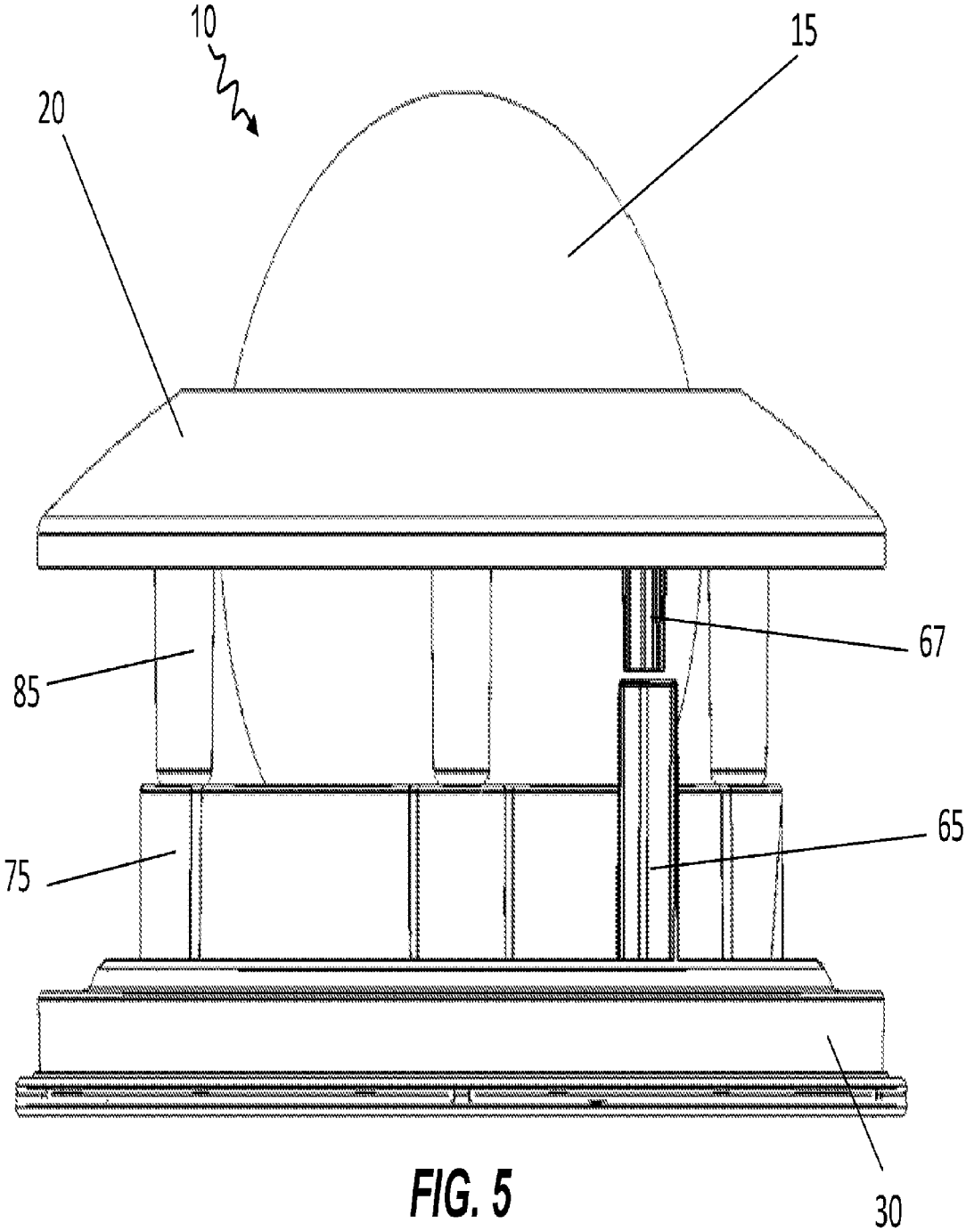
FIG. 5 is a side view of a massaging apparatus without a midsection housing and strap, according to one embodiment of the present invention.

With reference to FIG. 5, the connection between the upper and lower housings 20, 30 is shown in greater detail without the midsection housing (not shown). Protrusions 75 extending upwards out of the lower housing 30 are seen connected to recesses 85 extending downwards from the upper housing 20 by means of screws (not shown). The massage sphere is therefore limited to movement within the upper and lower housings 20, 30. T-bar 65 can be seen in its quasi-connection with the securing member 67, as was previously described. Once the strap (not shown) is connected to said T-bar 65, the movement of the strap (not shown) is limited by the presence of the securing member 67. The securing member 67 and T-bar 65 are constructed and arranged to abut against one another and secure strap 35 (not shown). The massage sphere is rotatably enclosed within the upper, midsection and lower housings.

Figure 6:
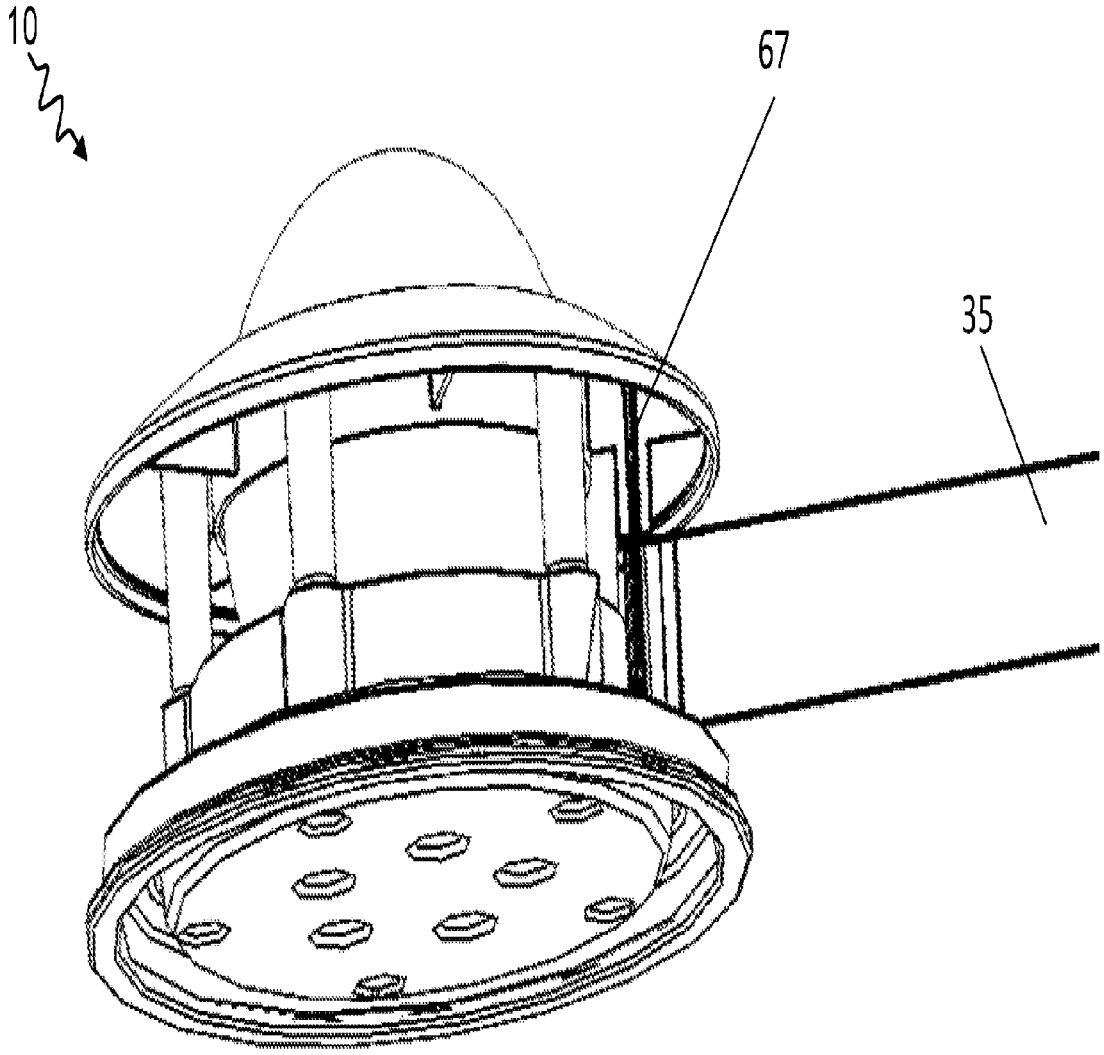
FIG. 6 is a perspective view of a massaging apparatus without a midsection housing, according to one embodiment of the present invention.

With reference to FIG. 6, the strap 35 is shown connected to the T-bar (not shown) in greater detail due to the absence of the midsection housing (not shown). The securing member 67 is shown, and prevents the strap 35 from being removed from within the massaging apparatus 10.

Figure 7:
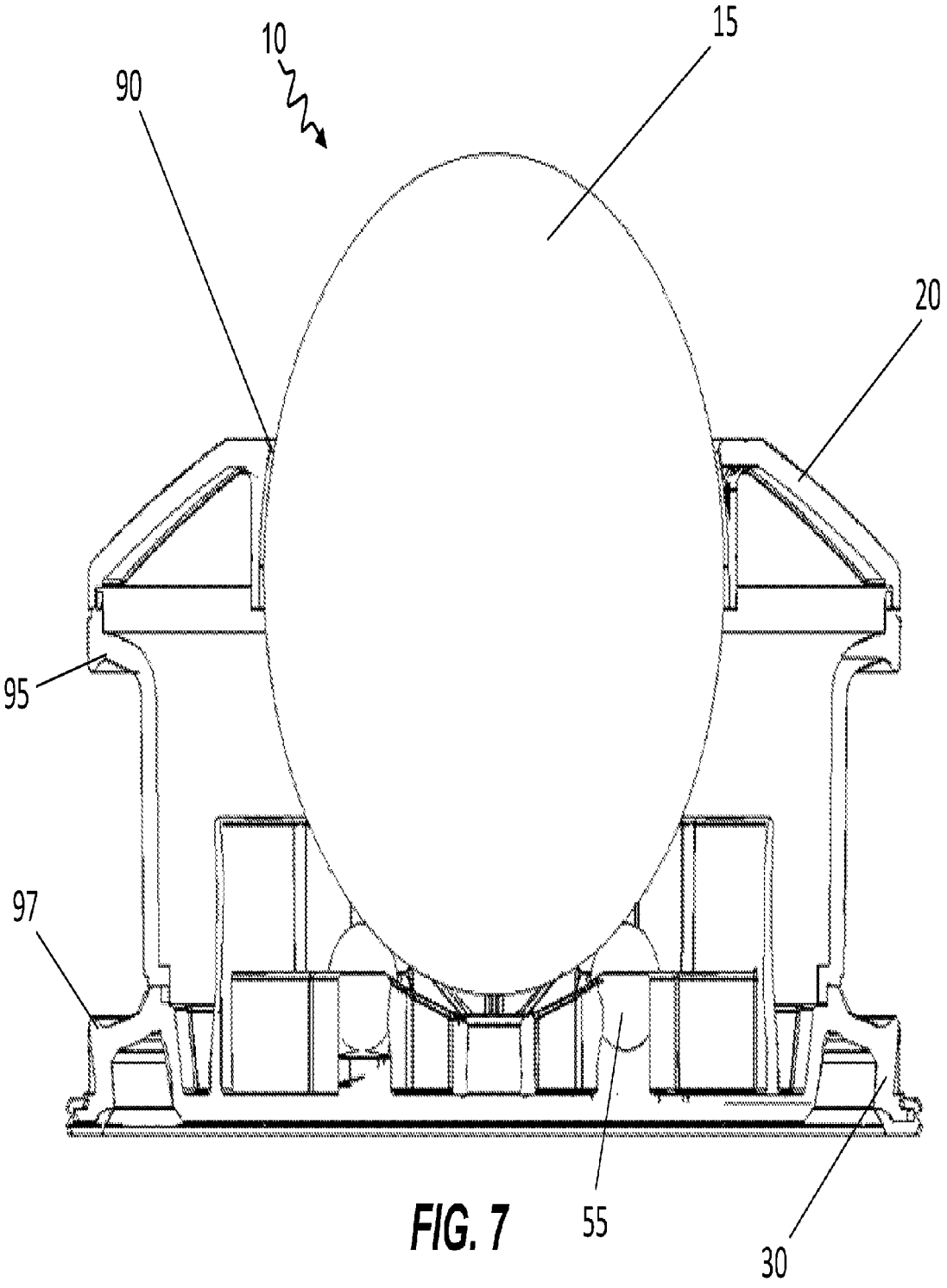
FIG. 7 is a cross-sectional front view of a massaging apparatus, according to one embodiment of the present invention.

With reference to FIG. 7, a cross-section of the massaging apparatus 10 is shown, illustrating in greater detail the relationship between the massage sphere 15 and the ball bearings 55. A worker skilled in the relevant art would be familiar with the motion of the larger massage sphere 15 and the five ball bearings 55 in the present invention, such that both the massage sphere 15 and the ball bearings 55 rotate along their own axes to create the circular motion of the massaging apparatus 10. While the present embodiment discloses five ball bearings, a worker skilled in the relevant art would be familiar with a multitude of ball bearings and a possible multitude of massage spheres that could be present in the device without departing from its scope. Further, the massage sphere could be rotated on a ring in order to rotate, or the massage sphere could be on 3 or more contact points, or nodes, which could enable said rotation. The massage sphere 15 remains in place within the massaging apparatus 10 as the diameter of the massage sphere 15 is wider than the diameter of an opening 90 of the upper housing 20. Indeed, the massage sphere 15 is wedged between the ball bearings 55 and the opening 90 such that it rotates on its own axis depending on the direction of the roll. The upper housing 20 has an opening 90 to receive a massage sphere of various dimensions.

Figure 8:
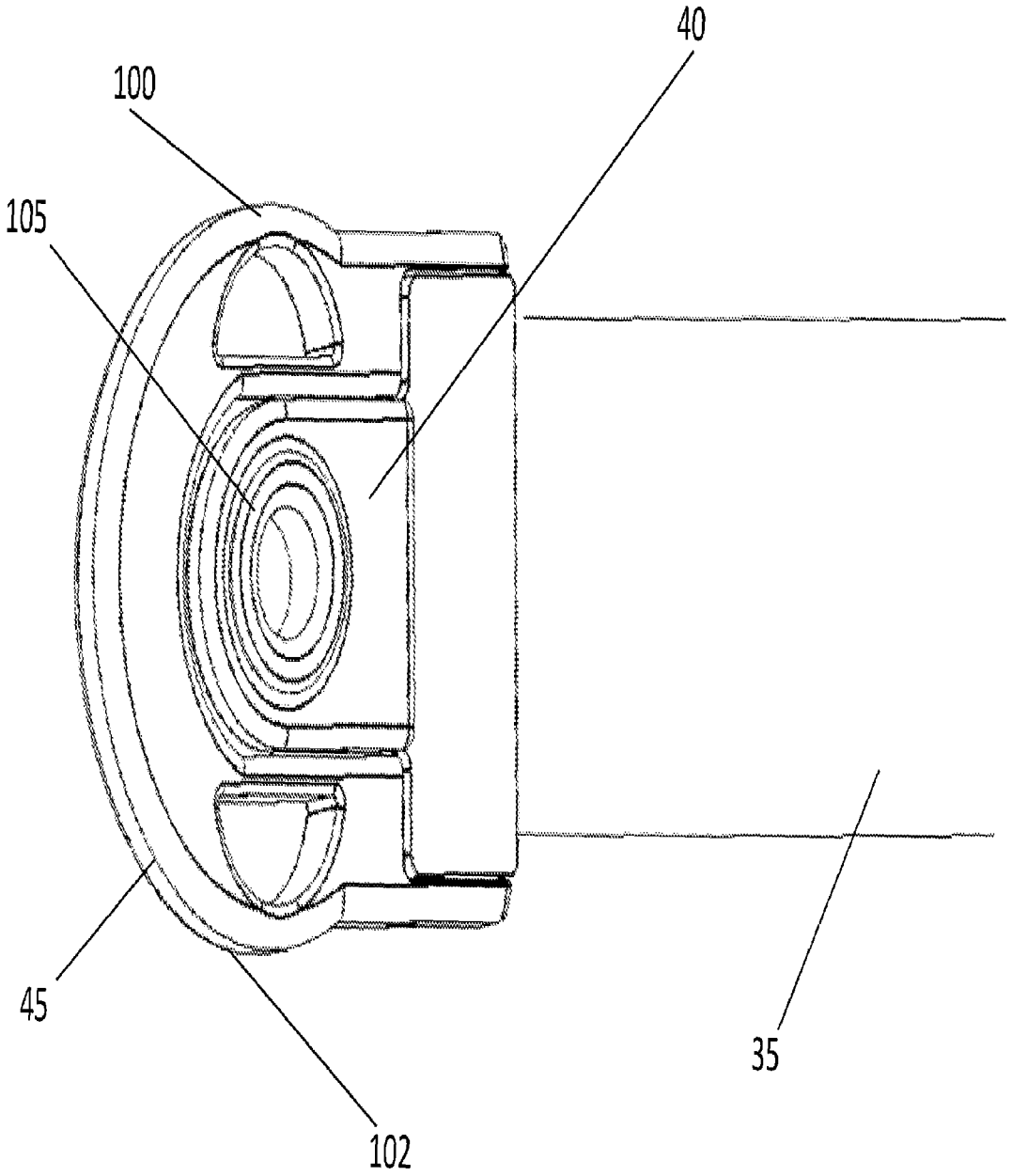
FIG. 8 is a perspective view of an interconnected male and female clasp attached to a strap of the massaging apparatus, according to one embodiment of the present invention.

With further reference to FIGS. 7 and 8, upper and lower lips 95, 97 are also shown, and serve to connect to first and second securing members 100, 102 of the male and female clasps 40, 45 around the massaging apparatus 10 when the device is either not in use and stored away, or if it is used with one hand only, such as for massaging one's leg or arm. This position of the massaging apparatus 10 is further explained below. In order to secure the male clasp 40 within the female clasp 45, a circular aperture (not shown) of the male clasp 40 is fitted onto a protrusion 105 of the female clasp 45. This serves to hold both male and female clasps 40, 45 together and thus the strap 35 can be coiled around the midsection housing (not shown) of the massaging apparatus 10.

Figure 9:
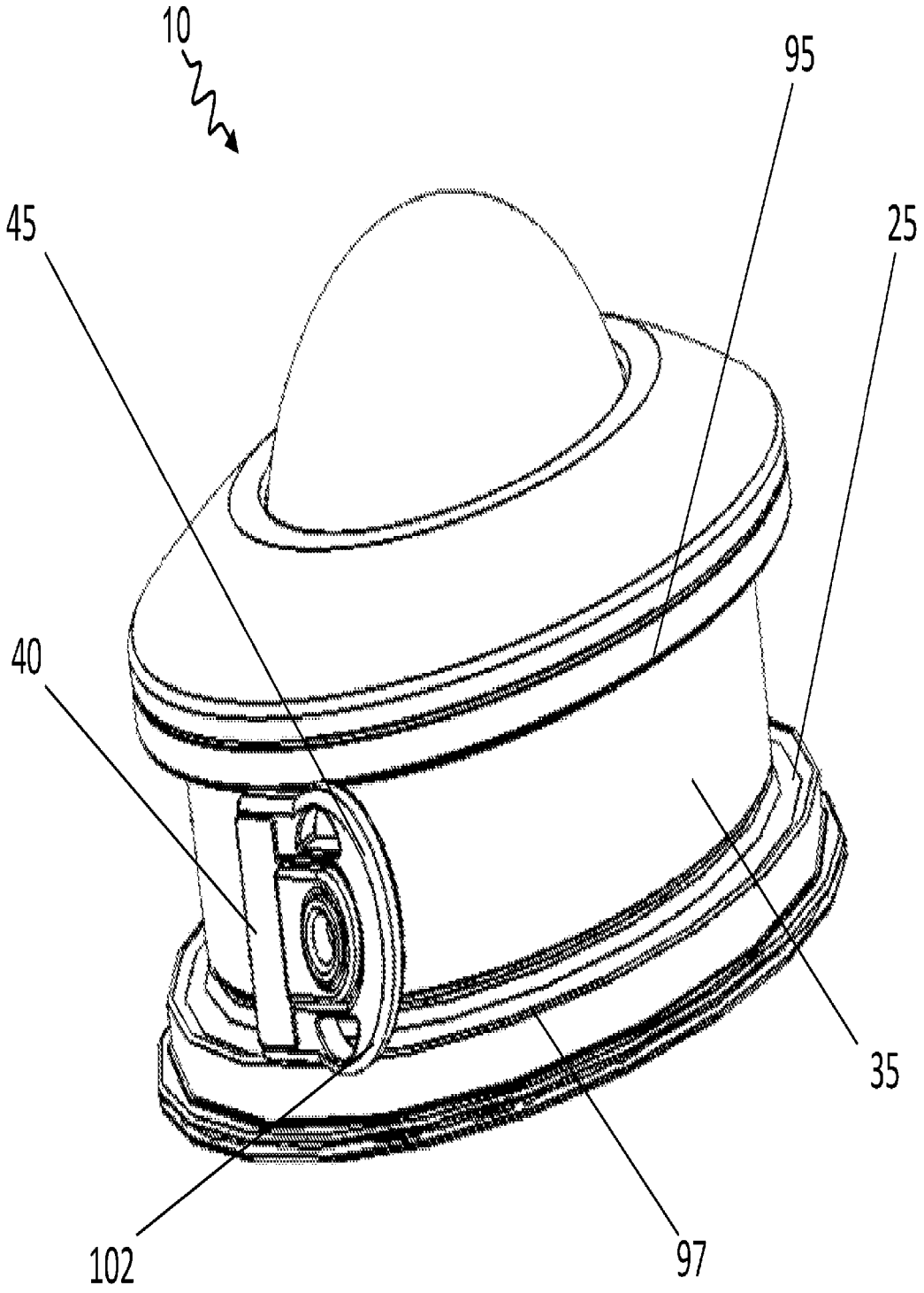
FIG. 9 is a perspective view of a massaging apparatus with a strap coiled around the midsection of the massaging apparatus, according to one embodiment of the present invention.
Figure 10A:
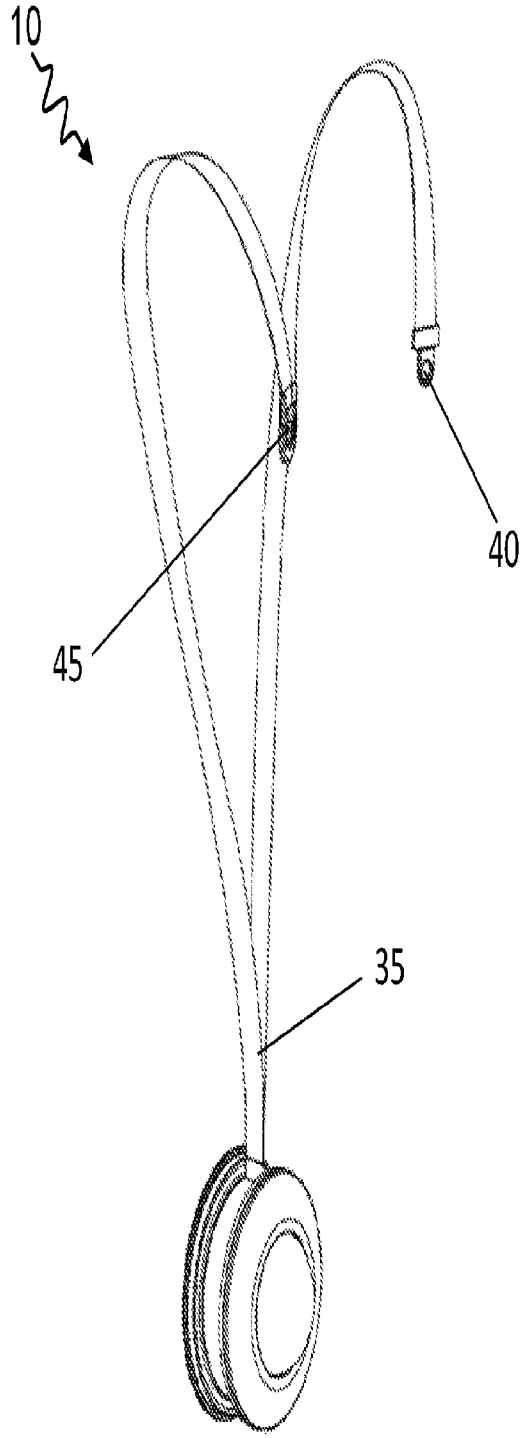
FIGS. 10A and 10B are perspective views of a massaging apparatus with the male and female clasps disconnected one from the other and the strap unraveled, according to one embodiment of the present invention.
Figure 10B:
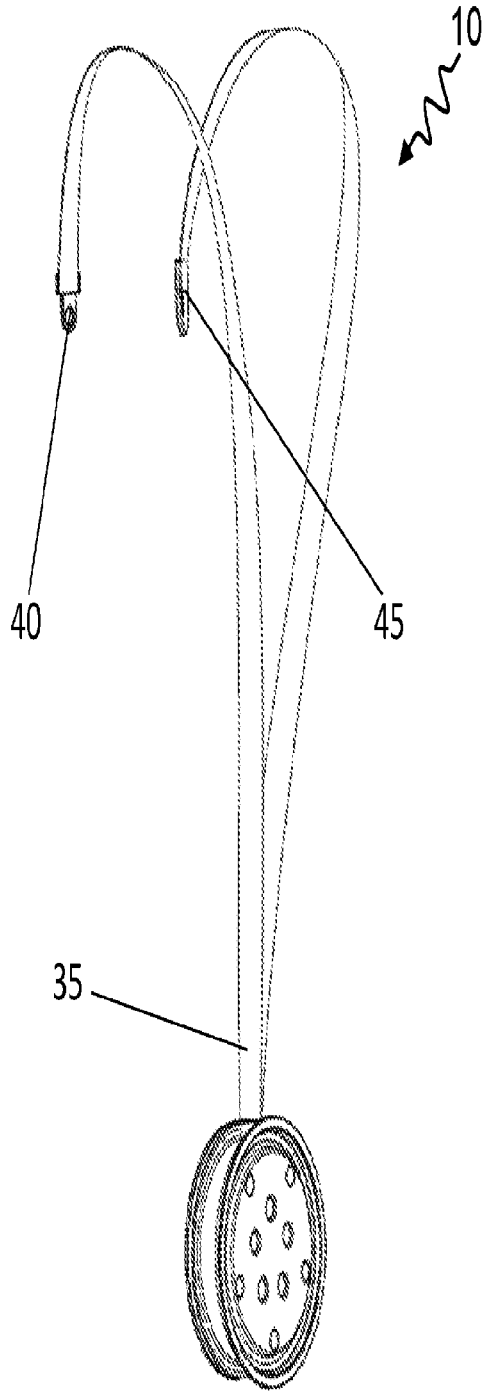
Figure 11A:
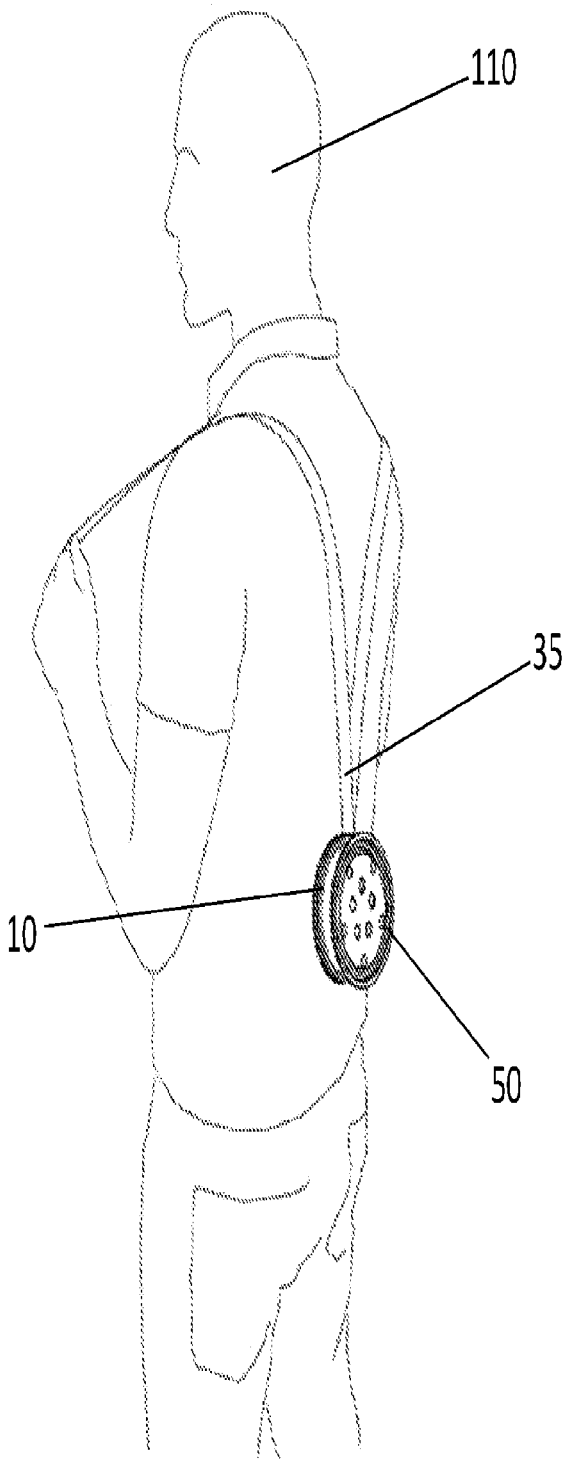
FIGS. 11A and 11B are perspective views of the massaging apparatus being utilized on a person's back, according to one embodiment of the present invention.
Figure 11B:
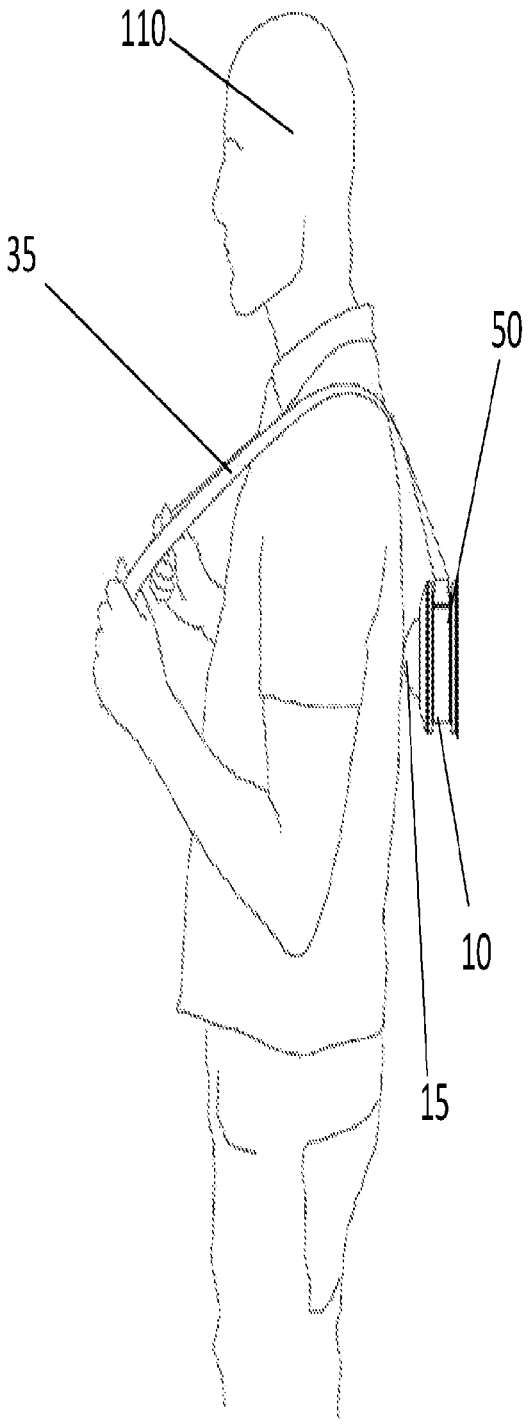

With reference to FIG. 9, the massaging apparatus 10 is shown with the strap 35 coiled around midsection housing 25. The male and female clasps 40, 45 are secured with the upper and lower lips, 95, 97 by means of first securing member (not shown) and second securing member 102. In order to detach the male and female clasps 40, 45 from the midsection housing 25, one simply needs to pull on the male and female clasps 40, 45 until the first securing member (not shown) and second securing member 102 detach themselves from the upper and lower lips 95, 97 of the midsection housing 25. A worker skilled in the relevant art can appreciate that the strap 35 can be secured to the midsection housing 25 by other means, such as a button connection, Velcro, a hook connecting to a loop etc., without departing from the scope of the invention. A worker skilled in the relevant art would also appreciate that the strap 35 could be retractable, such that instead of wrapping itself around the midsection housing 25 it would retract upon itself and onto T-bar (not shown) or other similar device.

With reference to FIGS. 10A, 10B, 11A and 11B, the male and female clasps 40, 45 of the massaging apparatus 10 are shown disconnected from one another. Once disconnected, a person 110 simply has to hold both male and female clasps 40, 45 and secure the device such that the massage sphere 15 is facing the back of the person 110. Meanwhile, the protective rim 50 faces a wall or other similar object and the person 110 can massage his or her back by applying pressure onto the massaging apparatus 10. The massage sphere 15 rolls around ball bearings (not shown) and massages the area as desired by exerting a massaging pressure onto said area and moving about. The massaging apparatus 10 can also be handheld and utilized on one's hands, arms, feet, legs, etc.

Figure 12:
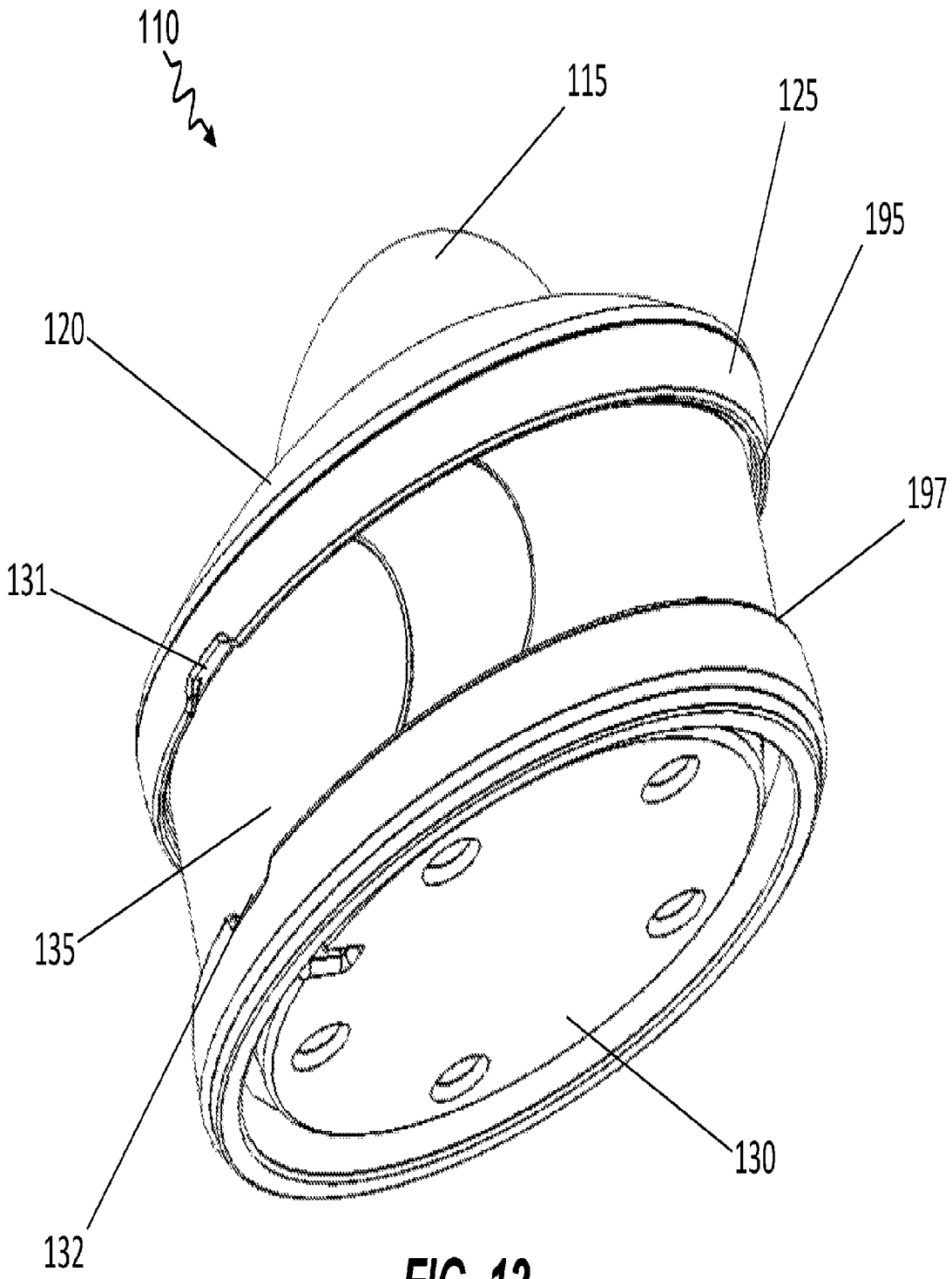
FIG. 12 is a lower perspective view of a massaging apparatus, according to a second embodiment of the present device.

With reference to FIG. 12 and according to a second embodiment of the present invention, a massaging apparatus 110 is generally comprised of a massage sphere 115, an upper, midsection and lower housing 120, 125, 130 and strap 135. In order for said strap 135 to be secured to the massaging apparatus 110, the width of the strap 135 is wider than the midsection housing 125, such that the strap 135 can be wrapped around the midsection housing 125 by means of upper and lower lips 195, 197. Indeed, the upper and lower lips 195, 197 act as securing means for the strap 135 such that said strap 135 cannot be removed without applying some force. First and second indentations 131, 132 are also shown on the second embodiment of the massaging apparatus 110, and serve to facilitate the displacement of the strap 135. Indeed, when the strap 135 is completely unravelled from the midsection housing 125, said strap 135 protrudes from an aperture (not shown) of the massaging apparatus 110. The aperture (not shown) is positioned exactly where the first and second indentations 131, 132 align. As the opening created by virtue of first and second indentations 131, 132 is wider than the normal opening of the midsection housing 125, the strap 135 is able to move more freely about when the massaging apparatus 110 is in use.

Although the invention has been described above by reference to certain embodiments of the invention, the invention is not limited to the embodiments described above. Modifications and variations of the embodiments described above will occur to those skilled in the art in light of the above teachings. Moreover, with respect to the above description, it is to be understood that the optimum dimensional relationships for the component members of the present invention may include variations in size, material, shape, form, funding and manner of operation.

What is claimed is:

1. A massaging apparatus comprising:

a massage sphere for applying massaging pressure;

an upper housing having an opening for receiving the massage sphere;

a midsection housing operatively connected to the upper housing surrounding the massage sphere;

a lower housing having a flat underside portion, the lower housing operatively connected to the midsection housing and enclosing the massage sphere, the lower housing including a friction pad positioned on the flat underside portion to create friction and allow the massaging apparatus to remain substantially immobile during operation;

fastening means for connecting the lower housing to the upper housing; and a strap secured to the midsection housing for movement of the massaging apparatus, and wherein the massage sphere is rotatably enclosed within the upper, midsection and lower housings.

2. The massaging apparatus of claim 1, wherein the upper housing includes recesses for engagement with the lower housing.

3. The massaging apparatus of claim 2, wherein the lower housing further includes protrusions for engagement with the recesses of the upper housing.

4. The massaging apparatus of claim 1, wherein the upper housing includes a securing member and the lower housing further includes a T-bar.

5. The massaging apparatus of claim 4, wherein the securing member and the T-bar are constructed and arranged to abut against one another and secure a loop of the strap, wherein the loop of the strap is looped around both the securing member and T-bar.

6. The massaging apparatus of claim 1, wherein the midsection housing includes an aperture from which protrudes the strap.

7. The massaging apparatus of claim 1, wherein the midsection housing includes an upper and a lower lip for engagement with a female clasp of the strap.

8. The massaging apparatus of claim 1, wherein the lower housing further includes cavities and at least three (3) ball bearings.

9. The massaging apparatus of claim 8, wherein the at least three ball bearings are rotatably positioned within the cavities, the at least three ball bearings being located between the cavities and the massage sphere.

10. The massaging apparatus of claim 1, wherein the strap includes a male and female clasp.

11. The massaging apparatus of claim 10, wherein the male clasp further includes first and second securing members for engagement with upper and the lower lips of the midsection housing.

12. The massaging apparatus of claim 1, wherein the fastening means includes screws.

13. The massaging apparatus of claim 1, wherein the massaging sphere protrudes from the upper and lower housing.

* * * * *